US009335668B2

(12) United States Patent
Mimbu et al.

(10) Patent No.: US 9,335,668 B2
(45) Date of Patent: May 10, 2016

(54) TRANSFER DEVICE AND IMAGE FORMING APPARATUS INCLUDING SAME

(75) Inventors: Ryuuichi Mimbu, Kanagawa (JP); Osamu Ichihashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 328 days.

(21) Appl. No.: 13/293,562

(22) Filed: Nov. 10, 2011

(65) Prior Publication Data

US 2012/0121293 A1 May 17, 2012

(30) Foreign Application Priority Data

Nov. 15, 2010 (JP) ..... 2010-255068
Oct. 31, 2011 (JP) ..... 2011-239240

(51) Int. Cl.
*G03G 15/16* (2006.01)
*G03G 21/16* (2006.01)

(52) U.S. Cl.
CPC ..... *G03G 15/161* (2013.01); *G03G 15/1605* (2013.01); *G03G 21/168* (2013.01); *G03G 21/1671* (2013.01); *G03G 2215/0129* (2013.01); *G03G 2215/0193* (2013.01)

(58) Field of Classification Search
CPC ..... G03G 15/161; G03G 15/1605; G03G 21/1671; G03G 21/168; G03G 2215/0193; G03G 2215/0129; G03G 2215/00409
USPC ..... 399/45, 66, 121, 297, 302, 308, 313, 399/317
See application file for complete search history.

(56) References Cited

U.S. PATENT DOCUMENTS 6,901,234 B2 5/2005 Ogiyama et al.
6,947,693 B2 9/2005 Kamiya et al.
7,502,583 B2 3/2009 Sawai et al.
7,532,370 B2 5/2009 Kudo et al.
7,742,721 B2 6/2010 Mimbu
(Continued)

FOREIGN PATENT DOCUMENTS

JP 06274051 A 9/1994
JP 08220901 A * 8/1996 ..... G03G 15/16
(Continued)

OTHER PUBLICATIONS

Abstract of JP 10-083124 published Mar. 31, 1998.
(Continued)

*Primary Examiner* — David Gray
*Assistant Examiner* — Laura Roth
(74) *Attorney, Agent, or Firm* — Harness, Dickey & Pierce, PLC

(57) ABSTRACT

A transfer device includes a moving device to move a contact surface of an opposing member toward and away from an image bearing surface of an image bearing member. The moving device includes a cam and a cam driving device to rotate the cam. When the cam is at a first position, the image bearing surface and the contact surface are separated. When the cam is at a second position, the image bearing surface and the contact surface contact each other. After a recording medium enters a transfer nip between the image bearing surface and the contact surface, the cam is at the second position, and when the recording medium exits the transfer nip a timing at which the cam starts to rotate from the second position to the first position changes depending on a thickness of the recording medium, to reduce pressure in the transfer nip.

14 Claims, 8 Drawing Sheets

(56) References Cited

U.S. PATENT DOCUMENTS

| | | | |
|---|---|---|---|
| 7,773,928 | B2 | 8/2010 | Ogiyama et al. |
| 8,036,550 | B2 | 10/2011 | Minbu |
| 2003/0219287 | A1 | 11/2003 | Ogiyama et al. |
| 2006/0056884 | A1 | 3/2006 | Sawai et al. |
| 2007/0258737 | A1 | 11/2007 | Ogiyama et al. |
| 2008/0124155 | A1 | 5/2008 | Mimbu |
| 2008/0232867 | A1 | 9/2008 | Minbu et al. |
| 2009/0060611 | A1 | 3/2009 | Minbu |
| 2009/0142083 | A1 | 6/2009 | Minbu |
| 2010/0061741 | A1 | 3/2010 | Minbu |
| 2010/0142985 | A1 | 6/2010 | Minbe et al. |
| 2010/0221029 | A1 | 9/2010 | Minbu et al. |
| 2010/0272478 | A1 | 10/2010 | Ichihashi |
| 2011/0064487 | A1 | 3/2011 | Ichihashi et al. |
| 2011/0158690 | A1 | 6/2011 | Mimbu et al. |
| 2011/0206399 | A1 | 8/2011 | Fujita et al. |
| 2011/0286759 | A1 | 11/2011 | Ichihashi et al. |
| 2011/0293312 | A1 | 12/2011 | Mimbu et al. |

FOREIGN PATENT DOCUMENTS

| | | | | | |
|---|---|---|---|---|---|
| JP | 10083124 | A | | 3/1998 | |
| JP | 11344877 | A | * | 12/1999 | ..... G03G 15/16 |
| JP | 2010134142 | A | | 6/2010 | |
| JP | 2011133653 | A | | 7/2011 | |

OTHER PUBLICATIONS

Abstract of JP 2010-134142 published Jun. 17, 2010.
Abstract of JP 2011-133653 published Jul. 7, 2011.
Abstract of JP 06-274051 published Sep. 30, 1994.

* cited by examiner

TRANSFER DEVICE AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application Nos. 2010-255068, filed on Nov. 15, 2010, and 2011-239240, filed on Oct. 31, 2011, both in the Japanese Patent Office, which are hereby incorporated herein by reference.

TECHNICAL FIELD

Exemplary aspects of this disclosure generally relate to a transfer device and an image forming apparatus including the same, and more particularly, to a transfer device having a moving device that moves an opposing member toward or away from an image bearing member of the image forming apparatus, and an image forming apparatus incorporating the transfer device.

BACKGROUND

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image bearing member; an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image bearing member after the toner image is transferred from the image bearing member onto the recording medium; finally, a fixing device applies heat and pressure to the recording medium bearing the unfixed toner image to fix the unfixed toner image on the recording medium, thus forming the image on the recording medium.

Typically, an image forming apparatus includes an image bearing member and a counter member disposed opposite the image bearing member. The image bearing member and the counter member form a transfer nip therebetween, at which an image can be transferred from the image bearing member to a recording medium such as a sheet of paper, etc. The counter member is pressed toward the image bearing member by a pressing device to contact the image bearing member to form the transfer nip. The counter member can be separated from the image bearing member using a moving device.

When a recording medium is relatively thick, shock jitter may occur at the transfer nip, and an undesirable imaging problem such as banding (i.e., uneven image concentration appearing as lines on an image) may occur. Such banding occurs when the thick recording medium enters the transfer nip, because the image bearing member receives a greater load abruptly, causing the linear velocity of the image bearing member to drop sharply.

To address such difficulty, in one approach, a rotatable cam is used to separate forcibly the counter member from the image bearing member. In this approach, a transfer roller is used as the counter member. The transfer roller includes a cylindrical roller body and a shaft projecting from both end of the roller body. The roller body and the shaft rotate integrally. Further, the rotatable cam is disposed at each end of the shaft and can rotate idly at each end of the shaft.

The rotatable cam, which can rotate idly about an outer surface of the shaft, has a convex portion at a given rotation angle position that contacts an axial end portion of the image bearing member such as a photoconductor. As the convex portion of the cam comes into contact with the transfer roller being pressed toward the photoconductor by a pressing device, the transfer roller can be separated forcibly from the photoconductor against the force so that a shaft-to-shaft distance between the photoconductor and transfer roller can be adjusted. For example, when thick paper is used as the recording medium, the transfer roller can be forcibly moved away from the photoconductor by the rotatable cam so that a transfer pressure is reduced.

With such a configuration, a sharp load increase at the photoconductor, which occurs when thick paper enters the transfer nip, can be suppressed or prevented. However, although the sharp load increase at the photoconductor can be prevented or suppressed by increasing the shaft-to-shaft distance, as a drawback, the transfer pressure is reduced, causing a transfer failure.

In another approach to prevent shock jitter, a rotatable cam rotates to separate the transfer roller from the photoconductor so as to form a minute gap therebetween before thick paper as a recording medium enters the transfer nip, thereby suppressing or preventing shock jitter. Immediately after the leading edge of the thick paper enters the minute gap, activation of a solenoid is canceled to cancel forced separation of the transfer roller so that the transfer roller can be pressed toward the photoconductor by a force of a spring used as a pressing device.

With such a configuration, the transfer roller is separated from the photoconductor until a recording medium such as a thick sheet of paper enters the transfer nip, but a sufficient transfer pressure is secured even after the forced separation of the transfer roller is cancelled.

Although advantageous, when separation of the transfer roller is canceled, the image bearing member, the recording medium, and the transfer roller may instantly collide with each other due to the force of the spring (pressing device), thereby causing a load increase or vibration at the image bearing member with possible image failure (or image deterioration) as a result.

BRIEF SUMMARY

In view of the foregoing, in an aspect of this disclosure, a transfer device includes an image bearing member, an opposing member, a pressing device, a recording medium feeder, a moving device, and a transfer mechanism. The image bearing member bears a toner image on an image bearing surface thereof. The opposing member is disposed facing the image bearing surface of the image bearing member to form a transfer nip therebetween. The opposing member includes a contact surface that contacts a recording medium. The pressing device presses the opposing member against the image bearing surface of the image bearing member to apply pressure in the transfer nip. The recording medium feeder feeds the recording medium to the transfer nip. The moving device moves the contact surface of the opposing member toward or away from the image bearing surface of the image bearing member, and includes a cam and a cam driving device to rotate the cam. The transfer mechanism transfers the toner image from the image bearing surface of the image bearing member to the recording medium in the transfer nip. When the cam is at a first position, the image bearing surface and the contact surface are separated, and when the cam is at a second position, the image bearing surface and the contact surface contact each other. After the recording medium enters the transfer nip the cam is at the second position and the pressing member applies pressure to the transfer nip, and when the recording medium exits the transfer nip a timing at which the cam starts to rotate from the second position to the first position changes depending on a thickness of the recording medium, to reduce an amount of pressure applied to the transfer nip by the pressing device.

According to another aspect, an image forming apparatus includes an image forming station, the transfer device, and a fixing device. The image forming station forms a toner image. The transfer device transfers the toner image onto the recording medium. The fixing device is disposed downstream from the transfer device, to fix the toner image on the recording medium.

The aforementioned and other aspects, features and advantages would be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF DISCLOSED EMBODIMENTS

Figure 1:
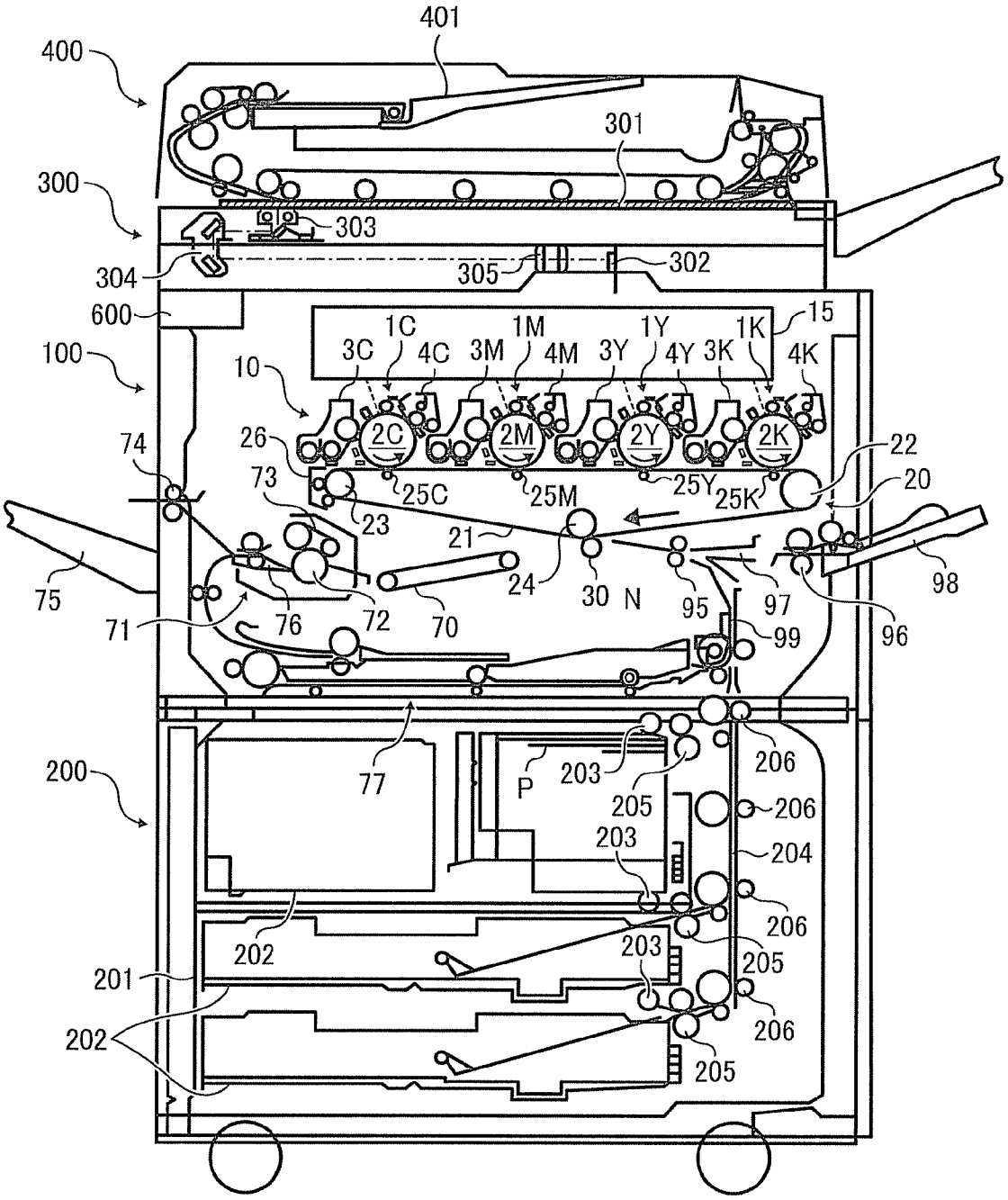
FIG. 1 is a schematic diagram illustrating an image forming apparatus according to an aspect of this disclosure.

A description is now given of illustrative embodiments. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially with reference to FIG. 1, a description is provided of overall configuration and operation of an image forming apparatus according to an aspect of this disclosure.

FIG. 1 is a schematic diagram illustrating a tandem-type color copier as an example of the image forming apparatus according to according to an aspect of this disclosure. The image forming apparatus includes a printer unit 100, a sheet feeding unit 200, a scanner 300, and an automatic document feeder (ADF) 400. The printer unit 100 serves as an image forming mechanism. The scanner 300 serves as an image reading mechanism and is disposed substantially above the printer unit 100. The ADF 400 is disposed substantially above the scanner 300.

The printer unit 100 includes a tandem image forming unit 10, a transfer unit 20, an optical writing unit 15, and so forth. The tandem image forming unit 10 is equipped with image twining stations 1C, 1M, 1Y, and 1K. The transfer unit 20 is equipped with a looped intermediate transfer belt 21 serving as an image bearing member and also an intermediate transfer body. The intermediate transfer belt 21 is formed into a loop and wound around a plurality of rollers: a drive roller 22, a driven roller 23, and a secondary transfer counter roller 24 serving as a support member. As viewed from the side, the intermediate transfer belt 21 forms an inverted triangular shape. As the drive roller 22 rotates, the intermediate transfer belt 21 is rotated endlessly in a clockwise direction indicated by an arrow in FIG. 1. Substantially above the intermediate transfer belt 21, the image forming stations 1C, 1M, 1Y, and 1K, one for each of the colors cyan, magenta, yellow, and black, are arranged in tandem facing the intermediate transfer belt 21 in the direction of movement of the intermediate transfer belt 21, and multiple toner images of a respective single color are formed in the image forming stations 1C, 1M, 1Y, and 1K.

It is to be noted that suffixes C, M, Y, and K denote the colors cyan, magenta, yellow, and black, respectively. To simplify the description, the reference characters C, M, Y, and K indicating colors are omitted herein unless otherwise specified.

The image forming stations 1C, 1M, 1Y, and 1K include photoconductive drums 2C, 2M, 2Y, and 2K, developing devices 3C, 3M, 3Y, and 3K, and cleaning devices 4C, 4M, 4Y, and 4K. The photoconductive drums 2C, 2M, 2Y, and 2K are rotated in a counterclockwise direction by a driving device, not illustrated, while contacting the intermediate transfer belt 21, thereby defining primary transfer nips between each of the photoconductive drums 2 and the intermediate transfer belt 21. The developing devices 3C, 3M, 3Y, and 3K develop electrostatic latent images formed on the photoconductive drums 2C, 2M, 2Y, and 2K with toner of respective colors. The cleaning devices 4C, 4M, 4Y, and 4K remove residual toner remaining on the photoconductive drums 2C, 2M, 2Y, and 2K after passing the primary transfer nip.

According to an aspect of this disclosure, the image forming stations 1C, 1M, 1Y, and 1K disposed along the belt moving direction constitute the tandem image forming unit 10 in the printer unit 100. In the printer unit 100, the optical writing unit 15 is disposed above the tandem image forming unit 10. The optical writing unit 15 illuminates the surface of the photoconductive drums 2C, 2M, 2Y, and 2K rotating in the counterclockwise direction with light to form electrostatic latent images thereon. Before illuminated with light by the optical writing unit 15, the image forming stations 1C, 1M, 1Y, and 1K are charged uniformly by charging devices, not illustrated.

The transfer unit 20 serving as a transfer device equipped with the intermediate transfer belt 21 and so forth also includes primary transfer rollers 25C, 25M, 25Y, and 25K inside the loop formed by the intermediate transfer belt 21, each facing the respective photoconductive drums 2. The primary transfer rollers 25C, 25M, 25Y, and 25K press the intermediate transfer belt 21 against the photoconductive drums 2C, 2M, 2Y, and 2K, respectively.

A secondary transfer roller 30 serving as an opposing member relative to the intermediate transfer belt 21 is disposed outside the loop formed by the intermediate transfer belt 21 below the intermediate transfer belt 21. The secondary transfer counter roller 24 is disposed opposite the secondary transfer roller 30 via the intermediate transfer belt 21, and supports the intermediate transfer belt 21 from inside the loop opposite a belt surface 21*a* of the intermediate transfer belt 21, thereby forming a secondary transfer nip N. The belt surface 21*a* is a surface that bears an image.

A recording medium P is introduced to the secondary transfer nip N at certain timing. Toner images of cyan, magenta, yellow, and black formed on the surface of the respective photoconductive drums 2 are transferred onto the belt surface 21*a* of the intermediate transfer belt 21 in the primary transfer nip so that they are superimposed one atop the other, thereby forming a composite toner image. Subsequently, the composite toner image is transferred secondarily onto the recording medium P in the secondary transfer nip N.

The scanner 300 includes a contact glass 301 and an image reader 302. The image reader 302 reads image information of a document placed on the contact glass 301. The image information read by the image reader is sent to a controller 600 of the printer unit 100. Although not illustrated, the controller 600 includes a central processing unit (CPU) that controls overall operation of the image forming apparatus as well as its associated memory devices, such as a read-only memory (ROM) storing program codes for execution by the CPU and other types of fixed data and a random-access memory (RAM) for temporarily storing data. Based on the image information received from the scanner 300, a light source such as a laser diode and an LED of the optical writing unit 15 in the printer unit 100 projects light for the colors cyan, magenta, yellow, and black to scan the photoconductive drums 2C, 2M, 2Y, and 2K and form the electrostatic latent images thereon. The electrostatic latent images are developed with toner into toner images of the colors cyan, magenta, yellow, and black during the development process.

The sheet feeding unit 200 includes a paper bank 201 having one or more sheet cassettes 202 each accommodating multiple recording media sheets and equipped with a sheet feed roller 203. The sheet feeding unit 200 also includes guide rollers 205 and sheet transport rollers 206, and other guide rollers or plates. The sheet cassette 202 stores a stack of recording media sheets. The sheet feed roller 203 picks up a top sheet from the stack of recording media sheets in the sheet cassette 202 and feeds it to the guide roller 205 that guides the recording medium P to a sheet conveyance path 204. The sheet transport roller 206 conveys the recording medium P to a sheet conveyance path 99 of the printer unit 100.

For manual feed, the image forming apparatus includes a sheet tray 98 for manually feeding a recording medium P and a separation roller 96. The recording medium P placed on the sheet tray 98 is supplied to a manual sheet conveyance path 97 one sheet at a time by a separation roller 96. The manual sheet conveyance path 97 merges the sheet conveyance path 99 in the printer unit 100.

Near the end of the sheet conveyance path 99, a pair of registration rollers 95 serving as a recording medium feeder is disposed. The recording medium P transported along the sheet conveyance path 99 is introduced between the pair of registration rollers 95 which, then, stops rotation to hold temporarily the recording medium P therebetween. The pair of registration rollers 95 starts to rotate again to feed the recording medium P to the secondary transfer nip N in appropriate timing such that the recording medium P is aligned with the composite toner image formed on the intermediate transfer belt 21.

According to an aspect of this disclosure, when making a color copy, a document is placed on a document table 401 of the ADF 400. Alternatively, the ADF 400 may be lifted up, and the document is placed on the contact glass 301 of the scanner 300. After placing the document on the contact glass 301, the ADF 400 is closed, and a start button, not illustrated, is pressed. If the document is placed on the ADF 400, the document is conveyed onto the contact glass 301. Subsequently, the scanner 300 is activated, thereby moving a first carriage 303 and a second carriage 304 along the document surface. The light source of the first carriage 303 illuminates the document surface with light. The light reflected by the document surface is deflected to the second carriage 304. The light is reflected by a mirror of the second carriage 304 and strikes the image reader 302 through an imaging lens 305. Accordingly, the document is read.

When receiving the image information from the scanner 300, a recording medium P having a size corresponding to the image information is fed to the sheet conveyance path 99. The drive roller 22 is rotated by the drive motor, thereby moving the intermediate transfer belt 21 in the clockwise direction. In the meantime, the photoconductive drums 2C, 2M, 2Y, and 2K of the image forming stations 1 start to rotate. Image forming process such as charging, optical writing, and development is performed on the photoconductive drums 2 while the photoconductive drums 2 rotate. Accordingly, the toner images of cyan, magenta, yellow, and black are transferred onto the intermediate transfer belt 21 in the primary transfer nip so that they are superimposed one atop the other, thereby forming a composite color toner image.

In the sheet feeding unit 200, one of the sheet feed rollers 203 is selected to rotate to pick up a recording medium P of a proper size from the sheet cassette 202. The recording medium P is introduced to the sheet conveyance path 204 by the guide roller 205 one sheet at a time. Subsequently, the recording medium P is transported to the sheet conveyance path 99 in the printer unit 100 via the sheet transport rollers 206.

When using the sheet tray 98, the sheet feed roller of the sheet tray 98 is rotated to send the recording medium to the separation roller 96. The separation roller 96 separates the recording medium P one by one and feeds it to the manual sheet conveyance path 97. The recording medium P is conveyed to the sheet conveyance path 99.

In the vicinity of the sheet conveyance path 99, the leading end of the recording medium P comes into contact with the pair of registration rollers 95, and the pair of registration rollers 95 stops rotation to hold the recording medium P therebetween. As rotation of the pair of registration rollers 95 resumes, the recording medium P is sent to the secondary transfer nip N in appropriate timing such that the recording medium P is aligned with the composite toner image formed on the intermediate transfer belt 21. Subsequently, the toner image is secondarily transferred onto the recording medium P in the secondary transfer nip by pressure and a secondary transfer bias serving as a transfer electric field.

The recording medium P on which the composite toner image has been transferred in the secondary transfer nip N is carried on a sheet conveyance belt 70 to a fixing device 71 disposed downstream from the secondary transfer nip N. The fixing device 71 includes a pressing roller 72 and a fixing belt 73. The pressing roller 72 and the fixing belt 73 meet and press against each other, thereby forming a fixing nip. The recording medium P is held in the fixing nip between the pressing roller 72 and the fixing belt 73 and supplied with pressure and heat. Accordingly, the composite toner image is fixed on the recording medium P, forming a color image thereon.

The recording medium P on which the color image is formed is discharged onto a sheet tray 75 via a pair of the sheet discharge rollers 74.

In a case in which an image is formed on the other side of the recording medium P, the recording medium P is discharged from the fixing device 71 and then sent to a reversing unit 77 by a switching claw 76. The switching claw 76 changes the direction of conveyance of the recording medium P. After the recording medium P is turned over, the recording medium P is sent to the pair of registration rollers 95. The recording medium P is sent again to the secondary transfer nip and then to the fixing device 71. After the toner image is fixed, the recording medium P is discharged onto the sheet discharge tray 75.

A belt cleaning device 26 is disposed upstream from the primary transfer nip for cyan which is the extreme upstream end of the primary transfer process, to contact the belt surface 21*a* of the intermediate transfer belt 21 after the recording medium P passes through the secondary transfer nip N. The belt cleaning device 26 removes residual toner remaining on the belt surface 21*a* of the intermediate transfer belt 21.

Figure 2:
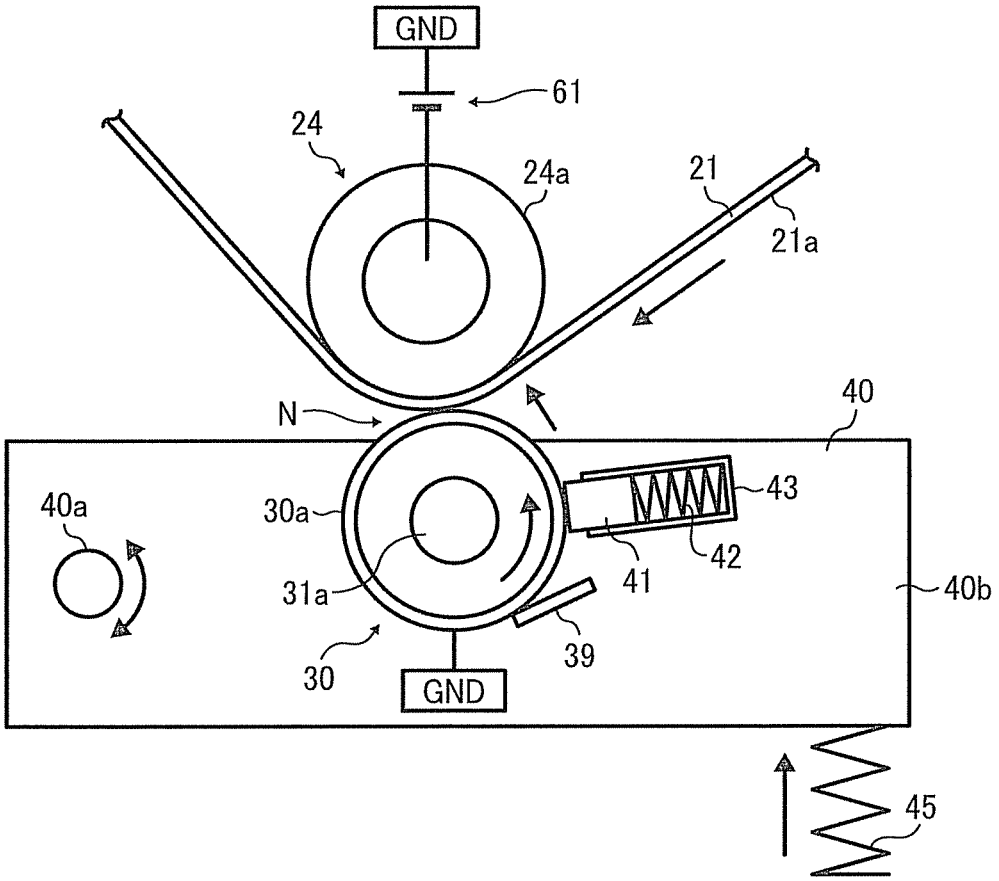
FIG. 2 is a partially enlarged schematic diagram illustrating a transfer device employed in the image forming apparatus of FIG. 1.

With reference to FIG. 2, a description is provided of the secondary transfer nip N and its surrounding configuration in the transfer device 20 of the printer unit 100 according to an aspect of this disclosure. As illustrated in FIG. 2, the secondary transfer counter roller 24 is disposed inside the loop formed by the intermediate transfer belt 21. The intermediate transfer belt 21 is wound partially around the secondary transfer counter roller 24. Accordingly, the secondary transfer counter roller 24 supports the intermediate transfer belt 21 while keeping a certain curvature of the intermediate transfer belt 21. In other words, the secondary transfer counter roller 24 serves as a backup roller.

The secondary transfer roller 30 disposed outside loop formed by the intermediate transfer belt 21 contacts the secondary transfer counter roller 24 via the belt surface 21*a* of the intermediate transfer belt 21. The secondary transfer roller 30 is rotatably supported by a roller unit holder 40 via a shaft bearing, not illustrated. The roller unit holder 40 is rotatable about a rotary shaft 40*a* parallel to an axis line of the secondary transfer roller 30. As the roller unit holder 40 rotates about the rotary shaft 40*a* in the counterclockwise direction, the secondary transfer roller 30 held by the roller unit holder 40 is pressed against the intermediate transfer belt 21, thereby funning the secondary transfer nip N therebetween. By contrast, as the roller unit holder 40 rotates about the rotary shaft 40*a* in the clockwise direction, the secondary transfer roller 30 held by the roller unit holder 40 separates from the intermediate transfer belt 21.

In the transfer device 20, a coil spring 45 serving as a pressing member presses an end portion 40*b* of the roller unit holder 40 against the intermediate transfer belt 21. The end portion 40*b* is across from the rotary shaft 40*a*. As the coil spring 45 presses the roller unit holder 40, enabling the roller unit holder 40 to rotate about the rotary shaft 40*a* in the counterclockwise direction, the secondary transfer roller 30 is biased toward the intermediate transfer belt 21.

The secondary transfer roller 30 is rotated in the counterclockwise direction by a rotary drive force of a roller drive motor, not illustrated, transmitted via a drive transmitter, for example, a gear. The roller drive motor and the drive transmitter are held by the roller unit holder 40 and rotate with the secondary transfer roller 30 and the roller unit holder 40. The roller unit holder 40 also holds a cleaning blade 39, a solid lubricant 41, and a lubricant pressing member 43, and so forth.

A surface 30*a* of the secondary transfer roller 30 contacts the belt surface 21*a* of the intermediate transfer belt 21 bearing the toner image. Accordingly, the toner on the belt surface 21*a* adheres to the surface 30*a* of the secondary transfer roller 30. If such toner remains on the surface of the secondary transfer roller 30, the toner sticks undesirably to the rear surface of the recording medium P in the secondary transfer nip N, contaminating the recording medium P.

To address such a problem, an edge portion of the cleaning blade 39 contacts the surface 30*a* of the secondary transfer roller 30 to mechanically remove the toner from the surface 30*a* of the secondary transfer roller 30. In this configuration, the cleaning blade 39 contacts the secondary transfer roller 30, thereby inhibiting rotation of the secondary transfer roller 30. Consequently, rotation of the intermediate transfer belt 21 cannot rotate the secondary transfer roller 30. For this reason, the roller drive motor is employed to rotate reliably the secondary transfer roller 30.

The coil spring 42 presses the lubricant pressing member 43, thereby pressing the solid lubricant 41 against the surface 30*a* of the secondary transfer roller 30 and applying the lubricant on the surface 30*a*. The solid lubricant 41 is made of, for example, zinc stearate. Application of the lubricant reduces friction between the cleaning blade 39 and the surface 30*a* of the secondary transfer roller 30, and prevents the edge of the cleaning blade 39 from curling undesirably. Instead of pressing the solid lubricant 41 against the surface 30*a* of the secondary transfer roller 30, a brush may be employed to scrape and apply the solid lubricant 41 on the surface 30*a*.

Conventionally, when the leading edge of the recording medium P enters the secondary transfer nip N between the belt surface 21*a* of the intermediate transfer belt 21 and the surface 30*a* of the secondary transfer roller 30, and when the rear end of the recording medium P exits the secondary transfer nip N, a change in the load against the intermediate transfer belt 21 causes an impact on the intermediate transfer belt 21, thereby changing the speed of the intermediate transfer belt 21. The impact becomes more significant when the thickness of a recording medium increases.

There is demand for an image forming apparatus capable of accommodating various types of a recording medium P. When a relatively thick recording medium P having a sheet weight of approximately 300 g/m$^2$ is used in the image forming apparatus, the impact becomes significant, causing shock jitter.

In view of the above, according to an aspect of this disclosure, sharp fluctuations in the load against the intermediate transfer belt 21 are reduced without degrading transferability when the leading edge of the recording medium P enters the secondary transfer nip N and/or the rear end portion of the recording medium P exits the secondary transfer nip N.

Figure 3:
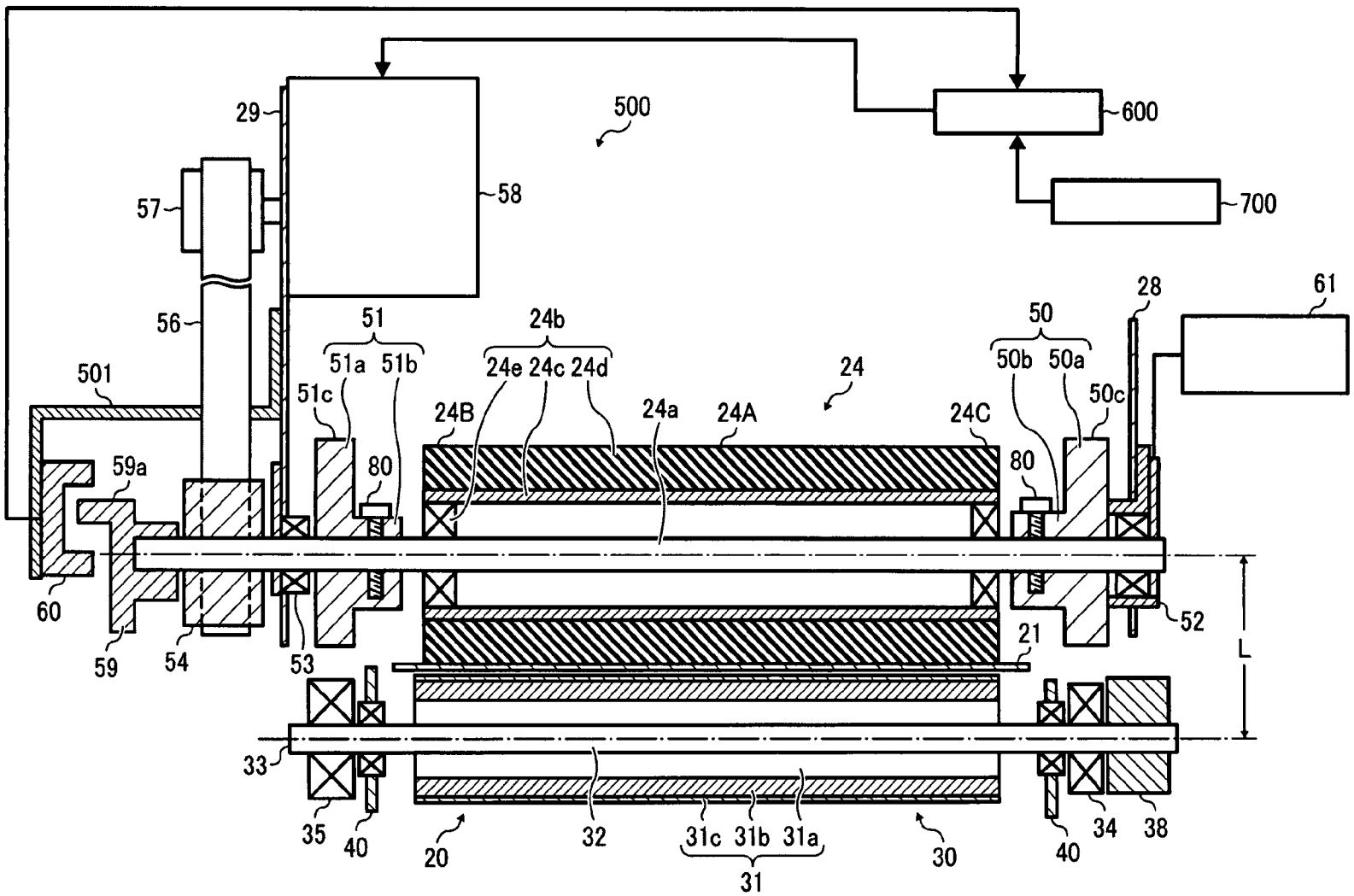
FIG. 3 is an enlarged cross-sectional view of the transfer device of FIG. 2.

With reference to FIG. 3, a description is provided of the transfer device 20 and the secondary transfer nip N. FIG. 3 is an enlarged schematic cross-sectional view illustrating the secondary transfer nip N and the surrounding configuration thereof. The secondary transfer roller 30 includes a roller body 31, a first shaft 32, a second shaft 33, a first idler roller 34, and a second idler roller 35.

The roller body 31 extends in a width direction of the recording medium P perpendicular to the direction of conveyance of the recording medium P. The first shaft 32 and the second shaft 33 project from end surfaces of the roller body 31 in the axial direction. The roller body 31 consists of a hollow, cylindrical metal core 31*a*, an elastic layer 31*b*, and an outer surface layer 31*c*. The elastic layer 31*b* is formed on the cylindrical metal core 31*a*. The outer surface layer 31*c* is fixed to the circumferential surface of the elastic layer 31*b*.

The hollow cylindrical metal core 31*a* is made of metal including, but not limited to, stainless steel and aluminum. It is desirable that the elastic layer 31 be formed of elastic material having a JIS-A hardness of equal to or less than 70[°]. Because the cleaning blade 39 contacts the roller body 31, various problems arise if the elastic layer 31*b* is too soft. Preferably, the elastic layer 31*b* is formed of elastic material having the JIS-A hardness of equal to or greater than 40[°]. The elastic layer 31*b* may be formed of epichlorohydrin rubber that is conductive to some extent, having the JIS-A hardness of approximately 50[°].

Alternatively, material for the conductive rubber may include, but is not limited to, EPDM and Si rubber in which carbon is dispersed, NBR having ionic conductive properties, and urethane rubber. Most rubber material shows good chemical affinity or has a relatively large friction coefficient relative to toner. Hence, the elastic layer 31*b* made of rubber material is covered with the outer surface layer 31*c*. With this configuration, toner is prevented from sticking to the surface of the roller body 31, and frictional load relative to the cleaning blade 39 is reduced. Preferably, material for the surface layer 31*c* includes, but is not limited to, fluorocarbon resin having a low friction coefficient and good releasability relative to toner, the fluorocarbon resin including a resistance adjuster such as carbon and an ionic conductive agent.

As the secondary transfer roller 30 rotates while contacting the belt surface 21*a* of the intermediate transfer belt 21*a*, the linear velocity of the secondary transfer roller 30 and the linear velocity of the belt surface 21*a* may differ slightly. In order to avoid slippage of the belt due to the difference in the linear velocity, the friction coefficient of the surface layer 31*c* is equal to or less than 0.3. The intermediate transfer belt 21 needs to rotate at a constant speed so that toner images of each color are aligned one atop the other when being transferred onto the intermediate transfer belt 21. Hence, it is important that the surface layer 31*c* of the secondary transfer roller 30 has a low surface friction resistance. The coil spring 45 presses the secondary transfer roller 30 against the intermediate transfer belt 21 wound around the secondary transfer counter roller 24 (shown in FIG. 2).

As illustrated in FIG. 3, the secondary transfer counter roller 24 consists of a cylindrical roller body 24*b* and a shaft 24*a*. The shaft 24*a* penetrates through the center of rotation of the roller body 24*b* in the axial direction. The roller body 24*b* rotates idly about the surface of the shaft 24*a*. The shaft 24*a* is made of metal and rotatably supports the roller body 24*b* on the circumferential surface thereof. The roller body 24*b* consists of a hollow, a drum-shaped hollow metal core 24*c*, an elastic layer 24*d*, and a ball shaft bearing 24*e*. The elastic layer 24*d* is fixed on the hollow metal core 24*c*. The ball shaft bearing 24*e* is pressed into both end portions of the hollow metal core 24*c* in the axial direction. The ball shaft bearing 24*e* rotates about the shaft 24*a* together with the hollow metal core 24*c* while supporting the hollow metal core 24*c*. The elastic layer 24*d* is pressed into the outer circumferential surface of the hollow metal core 24*c*.

The shaft 24*a* is rotatably supported by a first shaft bearing 52 and a second shaft ball bearing 53. The first shaft bearing 52 is fixed to a first side wall 28 of the transfer device 20. The second shaft ball bearing 53 is fixed to a second side wall 29 of the transfer device 20. It is to be noted that during printing operation, the shaft 24*a* is still most of the time. That is, the shaft 24*a* does not rotate. Rotation of the intermediate transfer belt 21 causes the roller body 24*b* to rotate idly about the shaft 24*a*.

The elastic layer 24*d* fixed on the circumferential surface of the hollow, hollow metal core 24*c* is made of conductive rubber material, a resistance of which is adjusted by adding an ionic conductive agent so that the elastic layer 24*d* has a resistance equal to or greater than 7.5 [Log Ω]. The reason for adjusting the electric resistance of the elastic layer 24*d* within a certain range is to prevent concentration of a transfer electric current at a portion of the secondary transfer counter roller 24 contacting directly the belt surface 21*a* in the secondary transfer nip N when a relatively small size such A5-size recording medium in the axial direction of the roller is used. When the recording medium P is small, an area of the secondary transfer counter roller 24 directly contacting the belt surface 21*a* increases in the secondary transfer nip N, thereby concentrating the transfer electric current. Where the electric resistance of the elastic layer 24*d* is greater than that of the recording medium P, such concentration of the transfer current can be suppressed.

According to an aspect of this disclosure, the elastic layer 24*d* is made of conductive rubber material such as rubber foam. The rubber foam has an elasticity of approximately 40 [°] on the Asker C hardness scale. With this configuration, the elastic layer 24*d* can deform flexibly in the thickness direction in the secondary nip N, thereby forming the secondary transfer nip N relatively wide in the direction of conveyance of the recording medium P.

To make the elastic material soft, a low-molecular component such as an elasticizer may be added. However, such a low-molecular component may seep out from the surface, contaminating the intermediate transfer belt 21 and hence degrading imaging quality. Therefore, rubber foam is used as the elastic layer 24*d*.

The outer diameter of the center portion of the elastic layer 24*d* is greater than the outer diameter of the end portions. In other words, the outer diameter of a center portion 24A is greater than that of end portions 24B and 24C of the secondary transfer counter roller 24. With this configuration, as the coil spring 45 (shown in FIG. 2) presses the secondary transfer roller 30 against the intermediate transfer belt 21, forming the secondary transfer nip N, distortion of the elastic layer 24*d* is prevented, hence reliably pressing the center portion 24A.

According to an aspect of this disclosure, as described with reference to FIG. 2, material for the secondary transfer roller 30 needs to be less elastic because the cleaning blade 39 contacts the secondary transfer roller 30. In view of the above, the roller body 24*b* of the secondary transfer counter roller 24 is made elastic, instead of the secondary transfer roller 30.

Can assemblies 50 and 51 serving as a moving mechanism are each disposed at both ends of the shaft 24*a* of the secondary transfer counter roller 24 in the longitudinal direction outside the roller body 24*b*, and contact the secondary transfer roller 30. The cam assemblies 50 and 51 are fixed to the shaft 24*a* so that they rotate together with the shaft 24*a*. More specifically, the cam assembly 50 is fixed to one end portion of the shaft 24*a* in the longitudinal direction.

The cam assembly 50 includes a cam 50*a* and a roller 50*b* arranged in the axial direction. The cam 50*a* and the roller 50*b* constitute a single integrated unit. The cam assembly 50 is fixed to the shaft 24*a* by penetrating a screw 80 through the roller 50*b* to engage the shaft 24*a*. The cam assembly 51 having the same configuration as the cam assembly 50 is fixed to the other end of the shaft 24*a* in the longitudinal direction. The cam assembly 51 includes a cam 51*a* and a roller 51*b*.

A pulley 54 is fixed to the shaft 24*a* outside the cam assembly 51 in the axial direction of the shaft 24*a*. A detection target disk 59 is fixed to the shaft 24*a* outside the pulley 54.

A cam drive motor 58 serving as a cam driving mechanism is fixed to the second side wall 29 of the transfer device 20. The cam drive motor 58 rotates the cam assemblies 50 and 51 in both forward and reverse directions. The cam drive motor 58 rotates a motor pulley 57 disposed on an output shaft of the cam drive motor 58 and transmits the drive force to the pulley 54 fixed to the shaft 24*a* via a timing belt 56. With this configuration, activation of the cam drive motor 58 rotates the shaft 24*a*. Even when the shaft 24*a* rotates, the roller body 24*b* can rotate idly on the shaft 24*a* so that the roller body 24*b* can be rotated by rotation of the intermediate transfer belt 21.

As the cam drive motor 58, a stepping motor can be used. By using the stepping motor, a rotation angle of the motor can be set flexibly without a rotation angle detector such as an encoder. Alternatively, a rotation angle detector may be provided to detect the rotation angle of the drive motor 58.

An outer circumferential surface 50*c* of the cam 50*a* and an outer circumferential surface 51*c* of the cam 51*a* are formed such that as rotation of the shaft 24*a* stops at a certain rotation angle, the cams 50*a* and 51*a* contact the secondary transfer roller 30 to push the secondary transfer roller 30 against the pressure of the coil spring 45 of the roller unit holder 40. In other words, the secondary transfer roller 30 is moved towards the secondary transfer counter roller 24 (intermediate transfer belt 21) by adjusting the position of rotation of the cam assemblies 50 and 51. Accordingly, a distance L between the shaft of the secondary transfer counter roller 24 and the shaft of the secondary transfer roller 30 is adjusted. By adjusting the distance L, a gap X (shown in FIG. 4) between the surface 30*a* of the secondary transfer roller 30 and the belt surface 21*a* of the intermediate transfer belt 21 in the secondary transfer nip N is adjusted.

According to an aspect of this disclosure, at least the cam assemblies 50 and 51, and the cam drive motor 58 constitute a moving mechanism 500 that adjusts the distance L between the shaft of the secondary transfer counter roller 24 and the shaft of the secondary transfer roller 30. In other words, the moving mechanism 500 enables the surface 30*a* of the secondary transfer roller 30 and the belt surface 21*a* of the intermediate transfer belt 21 to contact or separate from each other.

The secondary transfer counter roller 24 serving as a rotatable support member allows the roller body 24*b* to rotate idly about the shaft 24*a* penetrating inside the cylindrical roller body 24*b*. As the shaft 24*a* rotates, the cam assemblies 50 and 51 fixed at both ends of the shaft 24*a* in the axial direction rotate together. Therefore, both the cam assemblies 50 and 51 can be rotated by a single drive transmission mechanism disposed only at one side of the shaft 24*a* in the axial direction to transmit the drive force to the shaft 24*a*.

According to an aspect of this disclosure, while the hollow metal core 31*a* of the secondary transfer roller 30 is connected to ground, the hollow, hollow metal core 24*c* of the secondary transfer counter roller 24 is supplied with a secondary transfer bias having the same polarity as that of toner. In this configuration, a secondary transfer electric field is formed in the secondary transfer nip N to move toner from the secondary transfer counter roller 24 to the secondary transfer roller 30.

More specifically, the first shaft bearing 52 that rotatably bears the metal shaft 24*a* of the secondary transfer counter roller 24 consists of a conductive sliding bearing. A high-voltage power source 61 is connected to the first shaft bearing 52. The high-voltage power source 61 serves as a transfer mechanism that outputs the secondary transfer bias. The secondary transfer bias output from the high-voltage power source 61 is supplied to the secondary transfer counter roller 24 via the conductive first shaft bearing 52. Subsequently, the secondary transfer bias is transmitted to the shaft 24*a*, the ball shaft bearing 24*e*, the hollow metal core 24*c*, all of which are made of metal, and the conductive elastic layer 24*d* in the secondary transfer counter roller 24.

The detection target disk 59 fixed at one end of the shaft 24*a* includes a detection target 59*a* that rises in the axial direction at a predetermined position in the direction of rotation of the shaft 24*a*. An optical detector 60 is fixed to a bracket 501 fixed to the second side wall 29 of the transfer device 20.

As the shaft 24*a* rotates and comes to a predetermined rotation angle area, the detection target 59*a* of the detection target disk 59 enters between a light emitting element and a light receiving element of the optical detector 60, blocking a light path therebetween. When receiving light from the light emitting element, the light receiving element of the optical detector 60 sends a light-receipt signal indicating receipt of light to the controller 600.

The controller 600 is comprised of a known computer. In the present embodiment, the optical detector 60 and the cam drive motor 58 are connected to the controller 600. The controller 600 activates the cam drive motor 58 by calculating a time at which the light-receipt signal from the light receiving element of the optical detector 60 stops and calculating an amount of driving of the cam drive motor 58 based on the obtained time. Based on the calculated driving amount of the cam drive motor 58, the rotation angle position of the cam body 50*a* of the cam assembly 50 and the cam body 51A of the cam assembly 51 fixed to the shaft 24*a* is detected. Accordingly, the cam assemblies 50 and 51 are stopped at a predetermined position. A description of the predetermined position of the cam assemblies 50 and 51 is described later with reference to FIG. 4 and subsequent drawings.

The cam assemblies 50 and 51 come into contact with the secondary transfer roller 30 at a predetermined rotation angle, thereby pushing the secondary transfer roller 30 away from secondary transfer counter roller 24 against the pressure of the coil spring 45. In this case, the cam assemblies 50 and 51 "push down" the secondary transfer roller 30, and this movement is referred to as downward-push.

Here, an amount of downward-push by the cam assemblies 50 and 51 depends on the position of rotation angle of the cam assemblies 50 and 51. The distance L between the shaft of the secondary transfer counter roller 24 and the secondary transfer roller 30 increases as the amount of downward-push by the cam assemblies 50 and 51 increases.

The first idler roller 34 is provided to the first shaft 32 of the secondary transfer roller 30 rotating together with the roller body 31. The first idler roller 34 can rotate idly about the first shaft 32. The idler roller 34 has a disk-like shape, the center of which is hollow. The outer diameter of the idler roller 34 is slightly larger than the outer diameter of the roller body 31. The idler roller 34 itself can serve as a ball bearing and rotate idly about the circumferential surface of the first shaft 32.

The second idler roller 35 having the same configuration as the first idler roller 34 is provided to the second shaft 33 of the secondary transfer roller 30. The second idler roller 35 can rotate idly about the second shaft 33.

The outer circumferential surfaces 50*c* and 51*c* of the cams 50*a* and 51*a* are formed such that the outer circumferential surfaces 50*c* and 51*c* contact the first and the second idler rollers 34 and 35 at the predetermined rotation angle position. More specifically, the cam 50*a* of the cam assembly 50 fixed to one end of the shaft 24*a* comes into contact with the first idler roller 34 of the secondary transfer roller 30. Simultaneously, the cam 51*a* of the second cam assembly 51 fixed to the other end of the shaft 24*a* contacts the second idler roller 35 of the secondary transfer roller 30.

The first and the second idler rollers 34 and 35 contacting the cam assemblies 50 and 51 stop rotating. However, it does not affect rotation of the secondary transfer roller 30. Even when rotation of the idler rollers 34 and 35 stops, because the first and the second idler rollers 34 and 35 are ball bearings, the first shaft 32 and the second shaft 33 of the secondary transfer roller 30 can rotate independently of the first and the second idler rollers 34 and 35.

The cams 50*a* and 51*a* contact the first and the second idler rollers 34 and 35 to stop rotation of the first and the second idler rollers 34 and 35. Accordingly, friction between the idler rollers 34 and 35, and the cams 50*a* and 51*a* is prevented. Furthermore, a torque of the belt drive motor and the drive motor of the secondary transfer roller 30 is prevented from rising.

Figure 4:
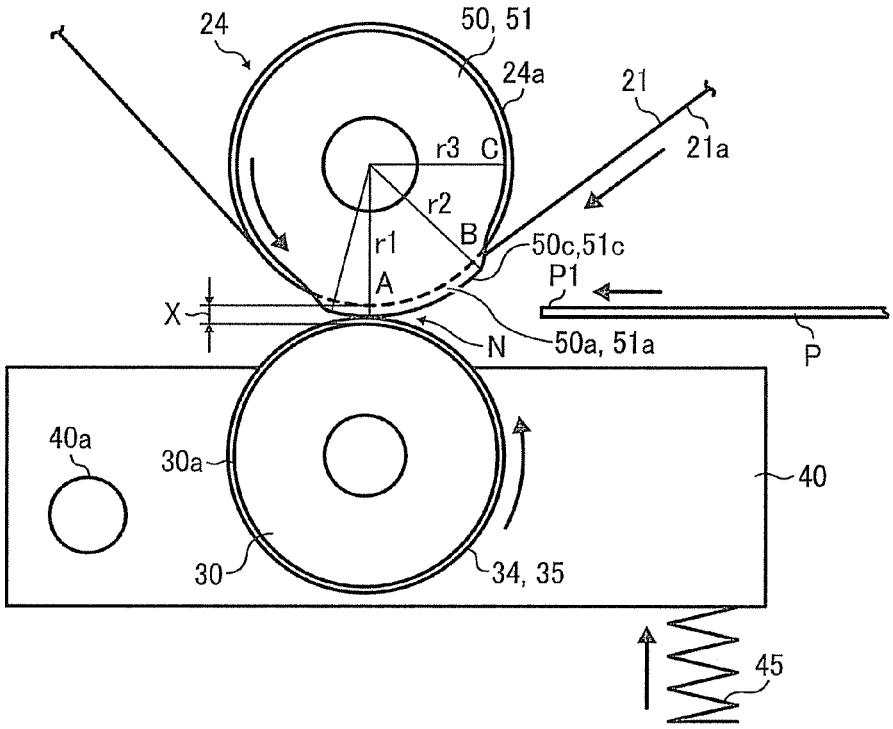
FIG. 4 is an enlarged schematic diagram illustrating the transfer device before a recording medium enters a transfer nip of the transfer device.
Figure 5:
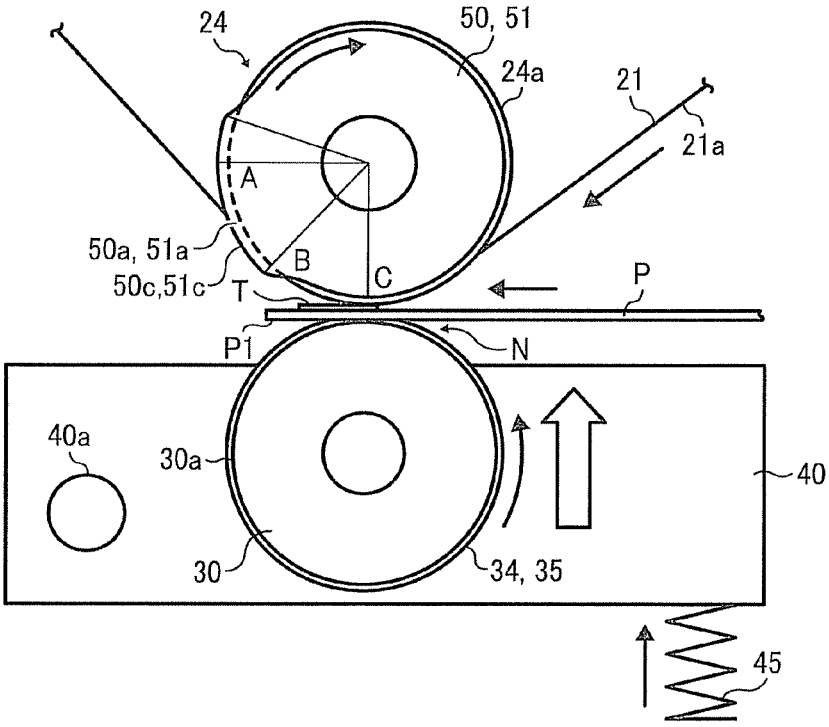
FIG. 5 is an enlarged schematic diagram illustrating the transfer device in a state in which the recording medium is in the transfer nip.
Figure 6:
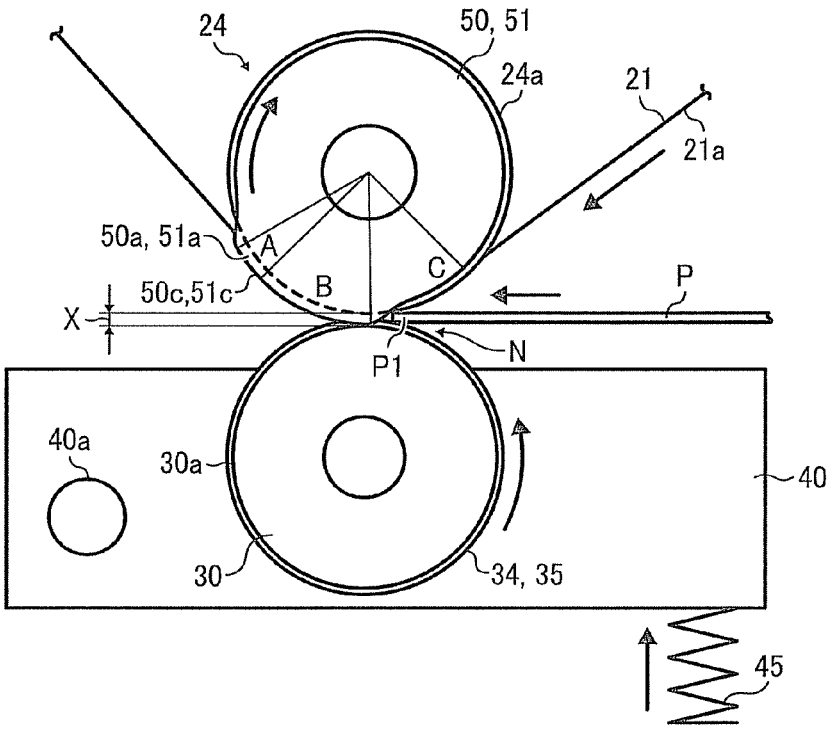
FIG. 6 is an enlarged schematic diagram illustrating the transfer device in a state in which the recording medium passes through the transfer nip.
Figure 7:
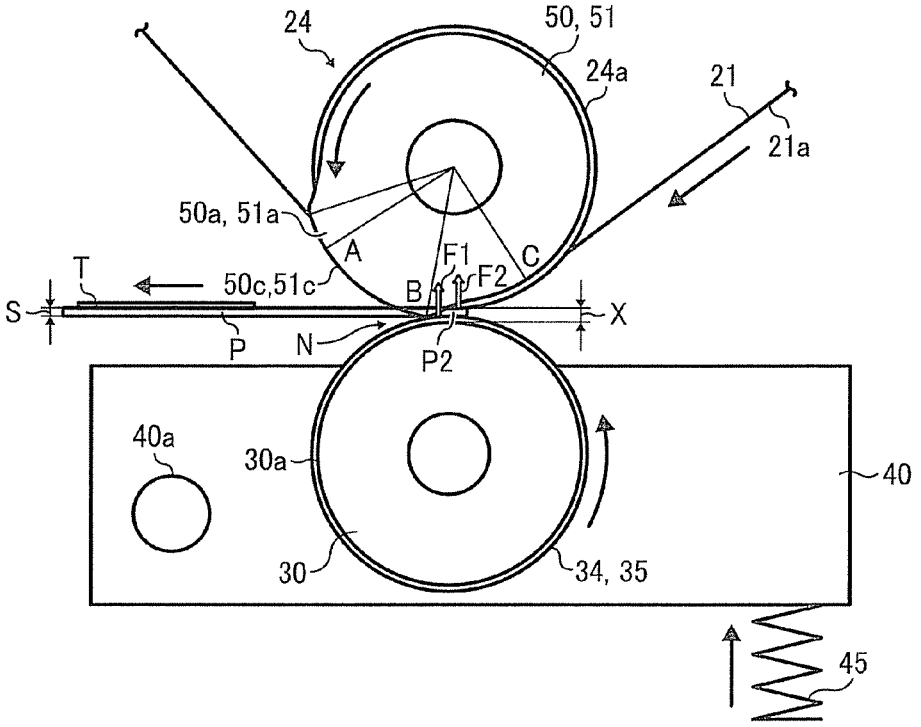
FIG. 7 is an enlarged schematic diagram illustrating the transfer device in a state in which the rear end of the recording medium passes through the transfer nip.

With reference to FIGS. 4 through 8, a description is provided of the cam assemblies 50 and 51. FIGS. 4 through 8 illustrate movement of the cam assemblies 50 and 51 when a relatively thick recording medium P is used. FIG. 4 is an enlarged schematic diagram illustrating the transfer device 20 before the recording medium P enters the secondary transfer nip N. FIG. 5 is an enlarged schematic diagram illustrating the transfer device 20 in a state in which the recording medium P is in the secondary transfer nip N. FIG. 6 is an enlarged schematic diagram illustrating the transfer device 20 as the recording medium P enters the secondary transfer nip N. FIG. 7 is an enlarged schematic diagram illustrating the transfer device 20 in a state in which the rear end of the recording medium P exits the transfer nip N. FIGS. 8A through 8D are graphs showing a relation between a time of start of the cams and shock jitter.

The cam assemblies 50 and 51 have the same configuration and disposed on the shaft 24*a* at the same phase. Whether the recording medium P is thick is determined by the controller 600 which receives a sheet identification signal input from an operation unit of the image forming apparatus. Based on the result provided by the controller 600, the cam drive motor 58 is controlled, thereby adjusting the position of the cam assemblies 50 and 51.

The cams 50*a* and 51*a* of the cam assemblies 50 and 51 have different radii from the center of rotation of the shaft 24*a*. More specifically, as illustrated in FIG. 4, a radius r1 at a position A and a radius r2 at a position B of the outer circumferential surfaces 50*c* and 51*c* are the same. The area from a position C to the position A has a radius r3 which is smaller than the radii r1 and r2. In other words, the outer circumferential surfaces 50*c* and 51*c* between the position A and the position B project from the area between the position C and the position A of the outer circumferential surfaces 50*c* and 51*c*.

When feeding a relatively thick recording medium P to the secondary transfer nip N, as illustrated in FIG. 4, the cams 50*a* and 51*a* are at the first position A at which the cams 50*a* and 51*a* come into contact with the idler rollers 34 and 35 and rotation of the shaft 24*a* is stopped. More specifically, when using a thick recording medium P, the controller 600 activates the cam drive motor 58 to change the phase of the cam assemblies 50 and 51, thereby pushing down the secondary transfer roller 30. The gap X is obtained between the surface 30*a* of the secondary transfer roller 30 and the belt surface 21*a* of the intermediate transfer belt 21 in the secondary transfer nip N.

As described above, where the gap X is formed between the surface 30*a* of the secondary transfer roller 30 and the belt surface 21*a* of the intermediate transfer belt 21 (secondary transfer counter roller 24), even when a relatively thick recording medium P enters the secondary transfer nip N, fluctuation of load relative to the intermediate transfer belt 21 and the secondary transfer roller 30 is suppressed, if not prevented. With this configuration, undesirable fluctuation of the moving speed of the intermediate transfer belt 21 is prevented when the leading edge of the recording medium P enters the secondary transfer nip N, hence preventing degradation of imaging quality.

When the thick recording medium P passes through the secondary transfer nip N while the secondary transfer roller 30 is pressed down (that is, when the gap X is formed), fluctuation of load relative to the intermediate transfer belt 21 is prevented and hence generation of shock jitter is suppressed. Although advantageous, since the secondary transfer roller 30 is pressed down, forming the gap X, a transfer pressure is reduced and may not be sufficient. If the transfer pressure is not sufficient in the secondary transfer nip N, the toner image T is not successfully transferred onto the recording medium P, resulting in degradation of transferability.

In particular, transferability drops significantly for a recording medium that is relatively thin (sheet weight in a range of approximately 160 g to 250 g) among thick recording media sheets, and a recording medium having a rough surface. In a case in which the recording medium P is relatively thick, immediately after the recording medium P enters the secondary transfer nip N, the secondary transfer roller 30 should not be pressed down in order to secure sufficient transfer pressure.

In general, a margin is provided between a leading edge P1 of the recording medium P and the leading edge of an image. For example, typically, a toner image T is formed on the recording medium P, 4 mm from the leading edge of the recording medium P. Therefore, to prevent degradation of the transferability of the leading edge of the image, the secondary transfer roller 30 needs to be returned to the position before it was moved by the cam assemblies 50 and 51, within the margin of the recording medium, that is, within 4 mm from the leading edge of the recording medium P. In particular, where the printing speed is high, the secondary transfer roller 30 needs to be returned to the position quickly to secure sufficient transfer pressure.

In view of the above, according to an aspect of this disclosure, the cam drive motor 58 is operated so as to rotate the shaft 24*a* of secondary transfer counter roller 24, thereby rotating the cam assemblies 50 and 51 in the clockwise direction. The cam assemblies 50 and 51 are stopped at the position C which is a second rotation position at which the cam assemblies 50 and 51 do not contact the idler rollers 34 and 35 of the secondary transfer roller 30. During image transfer operation, the phase of the cams is controlled such that the cam assemblies 50 and 51 remain separated from the idler rollers 34 and 35.

With this configuration, the secondary transfer roller 30 is pressed against the intermediate transfer belt 21 by the coil spring 45 via the recording medium P (thick). Accordingly, the transfer pressure is increased, and the transfer pressure greater than that of before the recording medium P enters the secondary transfer nip N is obtained. Hence, a sufficient transfer pressure is obtained during transfer operation, thereby preventing a transfer failure.

In order to move the secondary transfer roller 30 to the position before it was moved by the cam assemblies 50 and 51 in a short period of time, the cam drive motor 58 shown in FIG. 3 is initiated before the recording medium P enters the secondary transfer nip N between the secondary transfer roller 30 and the secondary transfer counter roller 24. After the cam drive motor 58 starts to operate, the controller 600 performs acceleration control of the motor until the cam assemblies 50 and 51 reach a predetermined rotation speed, for example, the maximum speed of the motor.

Although the cam assemblies 50 and 51 rotatably move during the acceleration control, the gap X between the surface 30*a* of the secondary transfer roller 30 and the belt surface 21*a* of the intermediate transfer belt 21 is secured in the secondary transfer nip N. This is because, as illustrated in FIG. 6, the radius r1 at the first position A at which the cam assemblies 50 and 51 contact the idler rollers 34 and 35 coincides with the radius r2 at the second position B which is a position of the cam assemblies 50 and 51 immediately after the recording medium P enters the secondary transfer nip N (r1=r2). Therefore, even when the cam assemblies 50 and 51 rotate, the gap X is secured.

According to an aspect of this disclosure, the outer circumferential surfaces 50*c* and 51*c* are formed such that the position of the secondary transfer roller 30 does not change even when the cam assemblies 50 and 51 rotate. Furthermore, the controller 600 accelerates the speed of the cam drive motor 58 in an area between the position B and the position C.

As described above, where the outer circumferential surfaces 50*c* and 51*c* include an area, having the same radius, that is, the area between the positions A and B, and the rotation speed of the cam drive motor 58 is accelerated in that area, the cam assemblies 50 and 51 can rotate at a predetermined speed, that is, at the maximum speed of the motor, from the position B to the position C in which the gap X is canceled. Accordingly, the secondary transfer roller 30 is returned to the position before it was pressed down by the cam assemblies 50 and 51 in a short period of time.

As acceleration control is performed before operation of returning the secondary transfer roller 30 to the position before it was pressed down by the cam assemblies 50 and 51, the secondary transfer roller 30 can return to the position, before the toner image T on the recording medium P arrives at the secondary transfer nip N. However, when the secondary transfer roller 30 comes into contact with the belt surface 21*a*, generating an impact, the intermediate transfer belt vibrates undesirably. Such vibration due to the impact causes rotational load at the intermediate transfer belt 21 and is transmitted to the photoconductive drums, hindering rotation of the photoconductive drums and hence degrading imaging quality.

In view of the above, according to an aspect of this disclosure, the elastic layer 24*b* of the secondary transfer counter roller 24 (shown in FIG. 3) is formed of low-resilient rubber foam, and the roller body has a diameter at the center thereof greater than that of both ends in the axial direction. With this configuration, as the secondary transfer roller 30 comes into contact with the belt surface 21*a*, the entire surface of the secondary transfer roller 30 does not contact the belt surface 21*a* at once. Instead, the secondary transfer roller 30 contacts the belt surface 21*a* gradually. Furthermore, elastic characteristics of the rubber foam of the elastic layer 24*b* allow the elastic layer 24*b* to absorb the impact when the secondary transfer roller 30 comes into contact with the belt surface 21*a*.

According to an aspect of this disclosure, not only when the recording medium P enters the secondary transfer nip N, but also when a rear end P2 of the recording medium P passes through the secondary transfer nip N, rotation of the cam drive motor 58 is controlled by the controller 600.

As illustrated in FIG. 7, before the rear end P2 of recording medium P exits the secondary transfer nip N, the controller 600 controls the cam drive motor 58 to start reverse rotation (in the counterclockwise direction in the present embodiment) of the cam assemblies 50 and 51, thereby moving the outer circumferential surfaces 50*c* and 51*c* of the cams 50*a* and 51*a* to the position A at which the outer circumferential surfaces 50*c* and 51*c* contact the idler rollers 34 and 35.

Where the gap X is greater than the thickness t of the recording medium as the cam assemblies 50 and 51 are counter-rotated from the position C (the second rotation position) to the position A (the first rotation position), the rear end P2 of the recording medium P exits the secondary transfer nip N. With this configuration, fluctuation of load due to vibration caused by the secondary transfer roller 30 coming into contact with the intermediate transfer belt 21 is suppressed, if not prevented entirely.

As described above, introducing the recording medium P to the secondary transfer nip N when the secondary transfer roller 30 is pressed down (in a state in which the gap X is formed) causes a poor transfer pressure and hence poor transferability for the toner image T. In particular, transferability drops significantly for a relatively thin recording medium (sheet weight in a range of approximately 160 g to 250 g)

among thick recording media sheets and a recording medium having a rough surface. Thus, a margin needs to be provided to the rear end P2 of the recording medium P. The cam assemblies 50 and 51 needs to move from the position C to the position A within the margin in a short period of time.

Moving from the position C to the position A, the cam assemblies 50 and 51 push down the secondary transfer roller 30 against the transfer pressure, causing significant load for the cam drive motor 58. As the rotation speed gets faster, the motor torque is reduced, hence necessitating a high-power motor which complicates efforts to make the image forming apparatus as a whole as compact as is usually desired. For this reason, the similar acceleration control performed at the leading edge of the recording medium P cannot be performed.

With reference to FIG. 7, a description is provided of the cam assemblies 50 and 51 during counter-rotation. During counter-rotation, the gap X increases gradually as the cam assemblies 50 and 51 rotatably move from the position C to the position B.

A force F2 (transfer pressure) applied by the coil spring 45 to the secondary transfer roller 30 and then to the secondary transfer counter roller 24 via the recording medium P (thick) and the intermediate transfer belt 21 decreases gradually and shifts to a contact force F1 of the idler rollers 34 and 35 contacting the cam assemblies 50 and 51. Further, as the cam assemblies 50 and 51 rotate, thereby increasing the gap X equal to or greater than the thickness S of the recording medium P, the pressure (transfer pressure) of the secondary transfer roller 30 pressing against the secondary transfer counter roller 24 via the recording medium P and the intermediate transfer belt 21 is reduced to zero. In other words, depending on the thickness of the recording medium P, a time for the transfer pressure to become zero differs.

As described above, low transfer pressure causes degradation of the transfer rate of the toner and the difference in time of decrease in the transfer rate.

According to an aspect of this disclosure, degradation of the transferability is suppressed, if not prevented entirely, by changing time of start of counter-rotation of the cam assemblies 50 and 51 depending on the thickness of the recording medium P. Furthermore, fluctuation of load of the intermediate transfer belt 21 caused by vibration generated when the secondary transfer roller 30 contacts the intermediate transfer belt 21 as the rear end P2 of the recording medium P exits the secondary transfer nip N is suppressed, if not prevented entirely.

FIGS. 8A through 8D show results of experiments of the transfer rate of toner and shock jitter in the image forming apparatus of FIG. 1 when the rear end of the recording medium exits the transfer nip N with different time of start of counter-rotation of the cam assemblies 50 and 51 and different thicknesses of the recording medium. In FIGS. 8A through 8D, a vertical axis shows a degree of shock jitter, and the horizontal axis shows a time (t) of start of counter-rotation of each cam.

More specifically, counter-rotation of the cams starts t(msec) before the rear end of a toner image arrives at the secondary transfer nip N, where a time at which the rear end of the toner image arrives at the secondary transfer nip N is zero (0). Where "t=100 msec", counter-rotation of the cam assemblies 50 and 51 is initiated 100 msec before the rear end of toner image arrives at the secondary transfer nip N. The experiments were performed using relatively thick recording media sheets with different thicknesses.

Figure 8A:
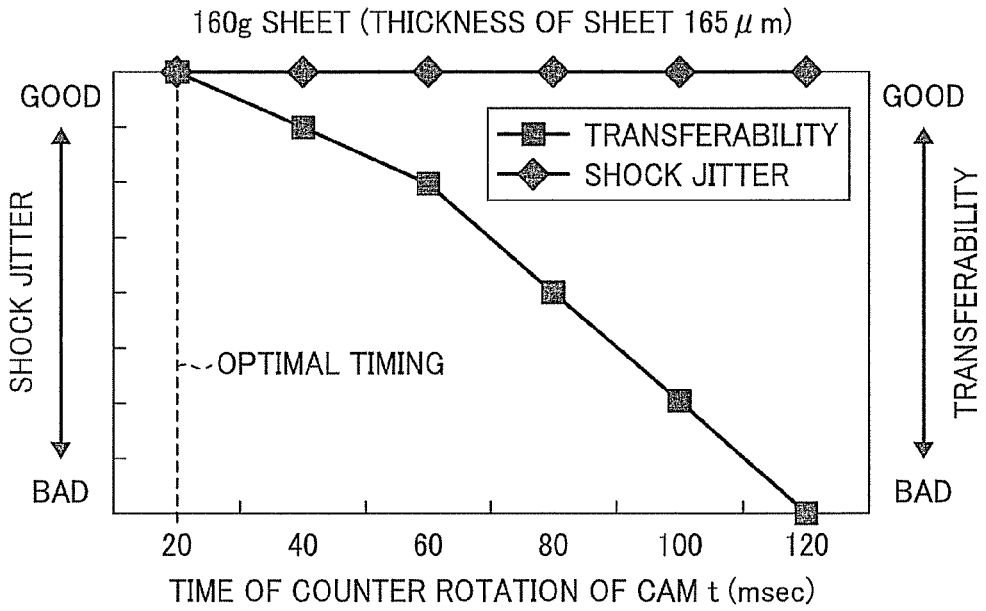
FIGS. 8A through 8D are graphs showing a relation between a time of start of a cam and shock jitter.
Figure 8B:
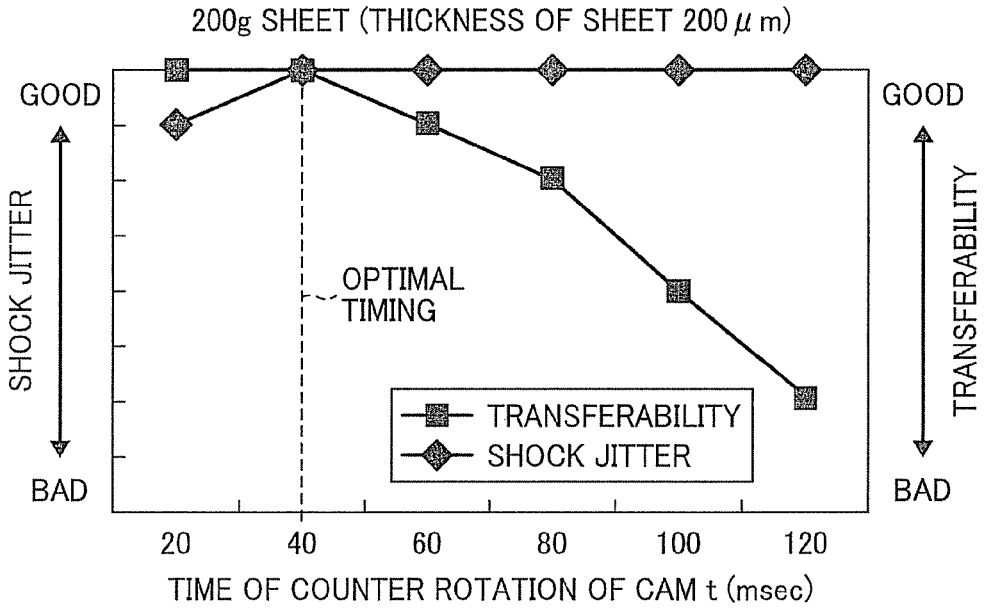
Figure 8C:
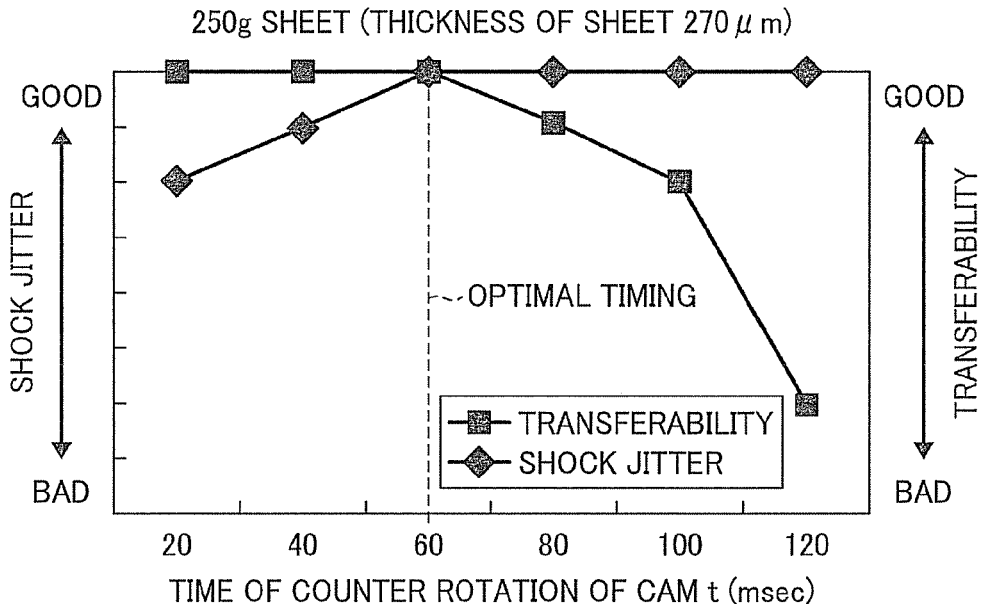
Figure 8D:
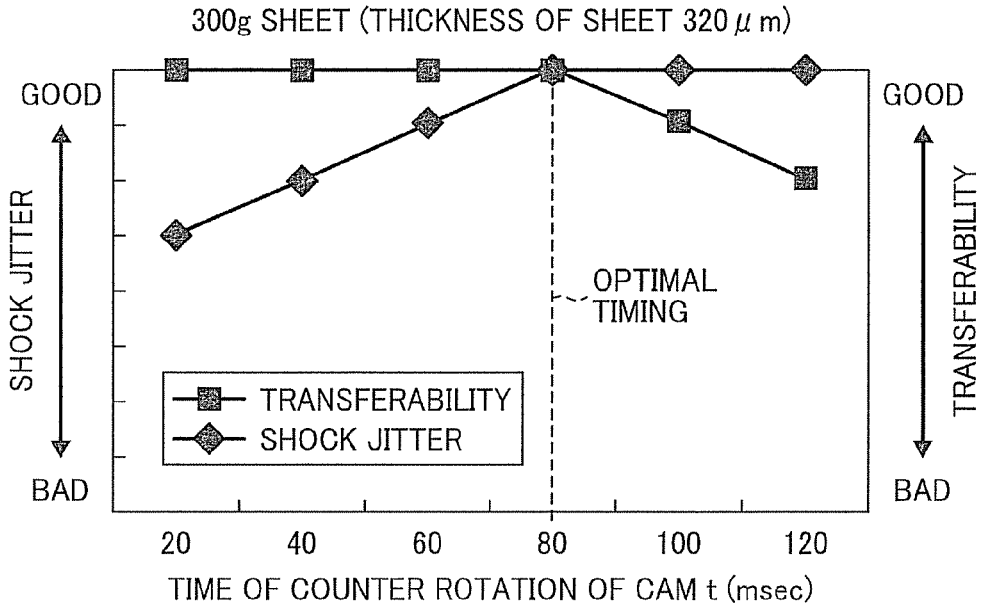

FIG. 8A shows a result using a recording medium having the sheet weight of 160 g (thickness 165 μm). FIG. 8B shows a result using a recording medium having the sheet weight of 200 g (thickness 200 μm). FIG. 8C shows a result using a recording medium having the sheet weight of 250 g (thickness 270 μm). FIG. 8D shows the result using a recording medium having the sheet weight of 300 g (thickness 320 μm).

As is understood from FIGS. 8A through 8D, an optimal timing for achieving desired transferability while preventing shock jitter depends on the thickness of the recording medium P. In other words, the time of start of counter-rotation of the cam assemblies 50 and 51 needs to be changed depending on a thickness of the recording medium. A user may enter the thickness of the recording medium P as a print mode. Alternatively, the thickness of the recording medium P may be detected by a detector or the like provided upstream from the secondary transfer nip N.

With this configuration, the time of start of counter-rotation of the cam assemblies 50 and 51 can be changed depending on the thickness of the recording medium P, thereby preventing shock jitter and degradation of transferability as the rear end of the recording medium P exits the secondary transfer nip N.

More specifically, as the recording medium P exits the secondary transfer nip N, the time of start of rotation of the cam assemblies 50 and 51 is changed depending on the thickness of the recording medium P so that the pressure in the secondary transfer nip N is reduced desirably. Accordingly, the secondary transfer roller 30 is prevented from striking the intermediate transfer belt 21 as the recording medium P exits the secondary transfer nip N, thereby preventing undesirable vibration of the intermediate transfer belt 21 and hence preventing degradation of imaging quality.

A relatively thick recording medium increases an amount of movement of the secondary transfer roller 30 pushed by the recording medium P. As the recording medium P exits the secondary transfer nip N, the amount of movement of the secondary transfer roller 30 towards the intermediate transfer belt 21 increases. As the secondary transfer roller 30 contacts the belt surface 21*a* of the intermediate transfer belt 21, the resulting impact becomes significant. In view of the above, according to an aspect of this disclosure, before the recording medium P exits the secondary transfer nip N, rotation of the cam assemblies 50 and 51 is initiated so that the intermediate transfer belt 21 and the secondary transfer roller 30 do not contact each other as the recording medium exits the secondary transfer nip N.

By contrast, an amount of movement of the secondary transfer roller 30 pushed by a relatively thin recording medium P is small. In this case, as the recording medium P exits the secondary transfer nip N, the impact caused by the secondary transfer roller 30 striking the belt surface of the intermediate transfer belt 21 is insignificant. Thus, depressurization is started after the recording medium P exits the secondary transfer nip N.

In other words, when using a thin recording medium, if rotation of the cam assemblies 50 and 51 is started at the same timing as when using the thick recording medium, that is, if rotation of the cam assemblies 50 and 51 is started before the recording medium P exits the secondary transfer nip N, sufficient transfer pressure is not secured, thus degrading transferability. By changing an amount of pressure depending on the thickness of the recording medium P, transferability is secured, and degradation of imaging quality due to fluctuation of the speed of the intermediate transfer belt 21 is prevented as the recording medium P exits the secondary transfer nip N.

Degradation of transferability and shock jitter after the rear end of the recording medium P exits the secondary transfer nip N are prevented by changing the start timing of counter-rotation of the cam assemblies 50 and 51 depending on the thickness of the recording medium P. However, a decrease in the image density is significant at the rear end of the recording medium P due to the following reason.

The speed of conveyance of the recording medium P in the secondary transfer nip N depends on the surface speed of the secondary transfer roller 30.

As described above, the secondary transfer roller 30 includes the hollow, cylindrical metal core 31*a* and the elastic layer 31*b* fixed to the metal core 31*a*. A change in the temperature causes expansion and contraction of the elastic layer 31*b*, thereby changing the surface speed of the secondary transfer roller 30 depending on the temperature, and hence changing the speed of conveyance of the recording medium P. The speed of conveyance of the recording medium P in the secondary transfer nip N increases where the diameter of the secondary transfer roller 30 expands.

In this case, the toner image T transferred onto the intermediate transfer belt 21 stretches when it is transferred onto the recording medium P. More specifically, the toner image T shifts undesirably to the rear end of the recording medium P, thereby decreasing an amount of a margin at the rear end of the recording medium. As a result, the image density at the rear end of the recording medium P drops significantly.

To address this difficulty, according to an aspect of this disclosure, the secondary transfer bias is increased depending on the start timing of the counter-rotation of the cam assemblies 50 and 51.

Figure 9:
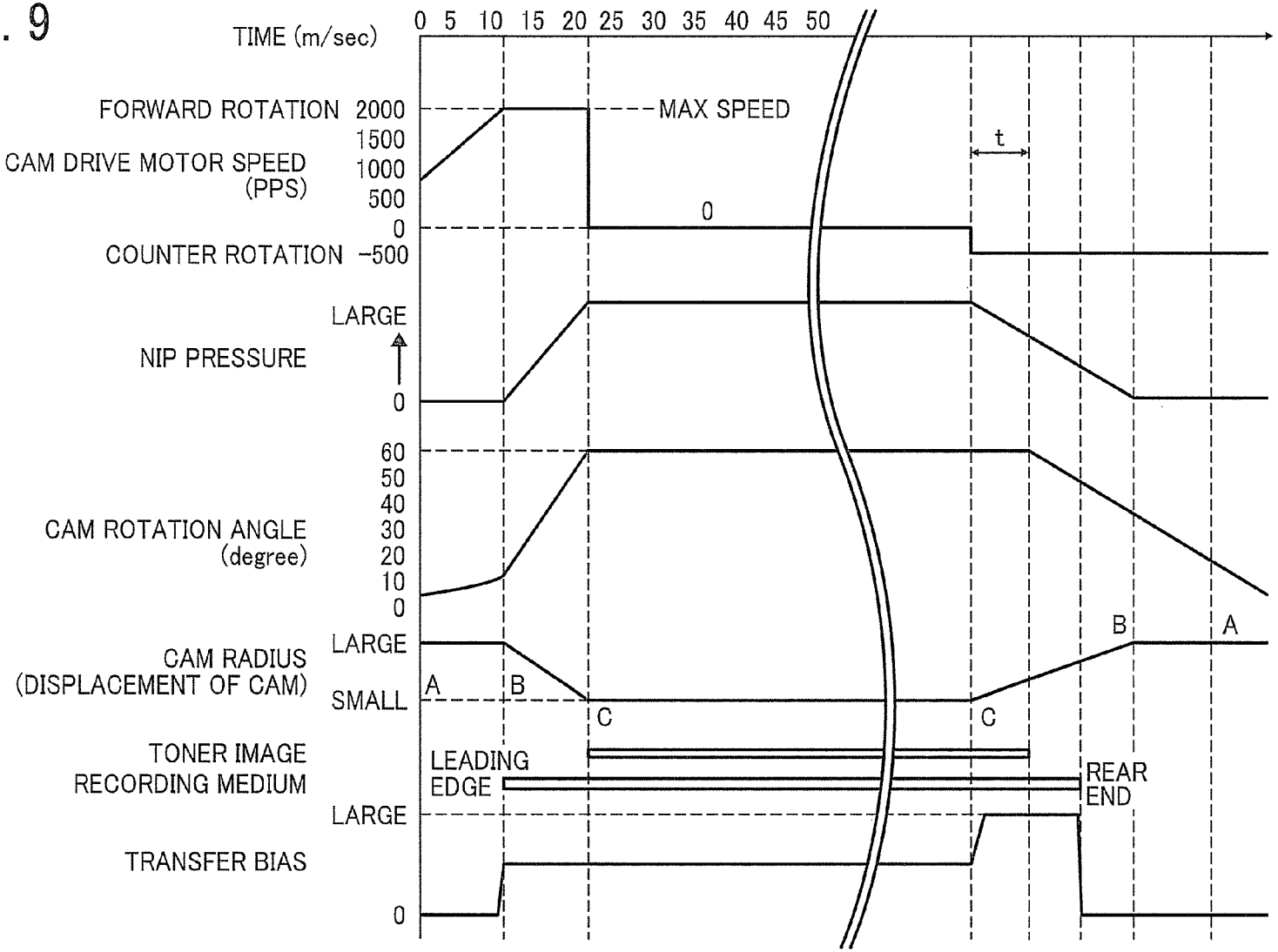
FIG. 9 is a timing diagram for a drive source of the transfer device, the cam, the recording medium, and image transfer.

With reference to FIG. 9, a description is provided of control of the secondary transfer bias. FIG. 9 is a timing diagram for the drive source of the transfer device 20, the cam assemblies 50 and 51, the recording medium P, and transfer of an image. In FIG. 9, the horizontal axis represents time, and the vertical axis represents a ratio of change of each component.

Before the recording medium P enters the secondary transfer nip N, the cam drive motor 58 is initiated and accelerated quickly to the target speed, for example, the maximum speed. The cam drive motor 58 is accelerated before the leading end P1 of the recording medium P arrives at the secondary transfer nip N. This is referred to as an acceleration control.

During the acceleration control, the cam assemblies 50 and 51 are rotated. The outer circumferential surfaces 50*c* and 51*c* of the cams 50*a* and 51*a* contacting the idler rollers 34 and 35 have the same radius, that is, the radius r1. Therefore, the gap X is secured, and the recording medium P passes therethrough.

The cams 50*a* and 51*a* move with an appropriate timing after the recording medium P enters the secondary transfer nip N, enabling the secondary transfer roller 30 to start moving. In other words, the diameter of the cams 50*a* and 51*a* changes, thereby changing the position of the cams from the position B to the position C. Accordingly, the gap X is not formed, and the transfer pressure is applied to the recording medium P.

While the cam drive motor 58 is rotated at the target speed, the cam assemblies 50 and 51 rotate fast. Hence, as illustrated in FIG. 9, the transfer pressure rises quickly. Accordingly, by the time the position of the toner image T on the recording medium P comes to the secondary transfer nip N, the transfer pressure is applied on the recording medium P completely.

The image forming apparatus includes, but is not limited to, a copier, a facsimile machine, a printer, and a multifunctional system. The image forming apparatus is not limited to a color image forming apparatus. The image forming apparatus may be a single-color image forming apparatus. According to an aspect of this disclosure, the teachings of the present disclosure may be applied to the secondary transfer nip N through which the recording medium passes. The teachings of the present disclosure may be applied to the primary transfer nip formed by the photoconductive drums, the intermediate transfer belt 21, and the primary transfer rollers 25C, 25M, 25Y, and 25K, in which the toner image T is transferred onto the recording medium P as the recording medium P is conveyed. In such a configuration, the same effect can be achieved.

According to an aspect of this disclosure described above, the cam assemblies 50 and 51 move the secondary transfer roller 30 to contact or separate from the intermediate transfer belt 21. Alternatively, the secondary transfer roller 30 may be provided with the cam assemblies 50 and 51, the support mechanism, and the cam drive motor 58. The secondary transfer counter roller 24 may contact or separate from the secondary transfer roller 30.

According to an aspect of this disclosure described above, the secondary transfer bias is supplied from the high-voltage power supply 61 to the secondary transfer counter roller 24. Alternatively, the secondary transfer bias may be supplied to the secondary transfer roller 30.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A transfer device, comprising:

an image bearing member configured to bear a toner image on an image bearing surface thereof;

an opposing member disposed facing the image bearing surface of the image bearing member to form a transfer nip therebetween, the opposing member including a contact surface that contacts a recording medium;

a pressing device configured to press the opposing member against the image bearing surface of the image bearing member to apply pressure in the transfer nip;

a recording medium feeder configured to feed the recording medium to the transfer nip;

a moving device configured to move the contact surface of the opposing member toward and away from the image bearing surface of the image bearing member, the moving device including a cam and a cam driving device to rotate the cam, wherein the cam has a first radius, a second radius and a third radius from a center of rotation of a shaft, the first radius and the second radius are the same and the third radius is smaller than the first radius or the second radius, and wherein when the cam is at a first position, the image bearing surface and the contact surface are separated, and when the cam is at a second position, the image bearing surface and the contact surface contact each other;

a transfer mechanism to transfer the toner image from the image bearing surface of the image bearing member to the recording medium in the transfer nip; and a controller to control the cam driving device, wherein a time of start of rotation of the cam is changed depending on a thickness of the recording medium, for a relatively thick recording medium, before the recording medium exits the transfer nip, a rotation of the cam is initiated so that the image bearing member and the opposing member do not contact each other as the recording medium exits the transfer nip, for a relatively thin recording medium, after the recording medium exits the transfer nip, a depressurization applied to the transfer nip by the pressing device is started so that an amount of movement of the opposing member is small.

2. The transfer device according to claim 1, wherein a transfer bias is changed when the cam starts to rotate from the second position to the first position as the recording medium exits the transfer nip.

3. The transfer device according to claim 1, further comprising a support member formed of a low-resilient elastic member and disposed opposite the image bearing surface of the image bearing member facing the opposing member, the support member supporting the image bearing member.

4. The transfer device according to claim 1, further comprising a support roller disposed opposite the image bearing surface of the image bearing member facing the opposing member, to support the image bearing member, the support roller including a metal core and a rubber foam layer disposed on an outer circumferential surface of the metal core.

5. The transfer device according to claim 1, wherein an image bearing member is a belt including an elastic layer.

6. The transfer device according to claim 1, wherein the opposing member is rotatably supported by a roller unit holder.

7. The transfer device according to claim 6, wherein the roller unit holder is rotatable about a rotary shaft parallel to an axis line of the opposing member.

8. The transfer device according to claim 6, wherein when the roller unit holder rotates about a rotary shaft thereof, the opposing member held by the roller unit holder is pressed against the image bearing surface.

9. The transfer device according to claim 6, wherein when the roller unit holder rotates about a rotary shaft thereof, the opposing member held by the roller unit holder is separated from the image bearing surface.

10. The transfer device according to claim 6, wherein the pressing device further includes a coil spring to press an end portion of the roller unit holder against the image bearing surface.

11. The transfer device according to claim 1, wherein an outer circumferential surface of the cam contacts an idler roller at a set rotational angle position.

12. The transfer device according to claim 1, wherein when the cam is positioned between the first radius and the second radius, the speed of the cam remains constant.

13. The transfer device according to claim 1, wherein when the cam is positioned between the second radius and the third radius, the speed of the cam accelerates.

14. An image forming apparatus, comprising:

an image forming station to form a toner image, a transfer device configured to transfer the toner image onto the recording medium; and a fixing device disposed downstream from the transfer device, to fix the toner image on the recording medium, the transfer device including:

an image bearing member configured to bear a toner image on an image bearing surface thereof;

an opposing member disposed opposite the image bearing surface of the image bearing member to form a transfer nip therebetween, the opposing member including a contact surface that contacts the recording medium;

a pressing device configured to press the opposing member against the image bearing surface of the image bearing member to apply pressure to the transfer nip;

a recording medium feeder configured to feed a recording medium to the transfer nip;

a moving device configured to move the contact surface of the opposing member toward and away from the image bearing surface of the image bearing member, the moving device including a cam and a cam driving device to rotate the cam, wherein the cam has a first radius, a second radius and a third radius from a center of rotation of a shaft, the first radius and the second radius are the same and the third radius is smaller than the first radius or the second radius, and wherein when the cam is at a first position, the image bearing surface and the contact surface are separated, and when the cam is at a second position, the image bearing surface and the contact surface contact each other; and a controller to control the cam driving device, wherein a time of start of rotation of the cam is changed depending on a thickness of the recording medium, for a relatively thick recording medium, before the recording medium exits the transfer nip, a rotation of the cam is initiated so that the image bearing member and the opposing member do not contact each other as the recording medium exits the transfer nip, for a relatively thin recording medium, after the recording medium exits the transfer nip, a depressurization applied to the transfer nip by the pressing device is started so that an amount of movement of the opposing member is small.

* * * * *